US009532918B1

(12) United States Patent
Louis et al.

(10) Patent No.: US 9,532,918 B1
(45) Date of Patent: Jan. 3, 2017

(54) HANDHELD MASSAGE DEVICE

(71) Applicants: John G Louis, Northfield, IL (US); Scott Padiak, Glencoe, IL (US)

(72) Inventors: John G Louis, Northfield, IL (US); Scott Padiak, Glencoe, IL (US)

( * ) Notice: Subject to any disclaimer, the term of this patent is extended or adjusted under 35 U.S.C. 154(b) by 592 days.

(21) Appl. No.: 14/020,417

(22) Filed: Sep. 6, 2013

Related U.S. Application Data

(63) Continuation-in-part of application No. 29/432,715, filed on Sep. 19, 2012, now Pat. No. Des. 689,620.

(51) Int. Cl.
*A61H 7/00* (2006.01)

(52) U.S. Cl.
CPC ..... *A61H 7/003* (2013.01)

(58) Field of Classification Search
CPC ..... A61H 7/00; A61H 7/002; A61H 7/003; A61H 7/005; A61H 15/00; A61H 15/0078; A61H 15/0085; A61H 15/0092; A61H 15/002; A61H 39/02; A61H 39/04; F16B 7/042; F16B 7/0406; F16B 7/0413; A45B 19/08
See application file for complete search history.

(56) References Cited

U.S. PATENT DOCUMENTS

| | | | | |
|---|---|---|---|---|
| 1,612,343 | A | 12/1926 | Amussen | |
| 2,441,686 | A | 5/1948 | Cohen | |
| 2,477,666 | A | 8/1949 | Smallen | |
| D185,286 | S | 5/1959 | Taran | |
| 3,856,002 | A | 12/1974 | Matsumoto | |
| 4,266,536 | A * | 5/1981 | Casares | A61H 15/0092 601/119 |
| D268,362 | S | 3/1983 | Wong | |
| 4,798,198 | A | 1/1989 | Wright | |
| 4,869,280 | A * | 9/1989 | Ewing | F16B 7/042 135/69 |
| D317,204 | S | 5/1991 | Henneseey | |
| D326,525 | S | 5/1992 | Shimizu | |
| D326,721 | S | 6/1992 | Ujifusa et al. | |
| D336,959 | S | 6/1993 | Liming | |
| D340,527 | S | 10/1993 | Goodell | |

(Continued)

FOREIGN PATENT DOCUMENTS

DE 102007035754 * 2/2009 ..... A45B 7/00

*Primary Examiner* — Justine Yu
*Assistant Examiner* — Michael Tsai
(74) *Attorney, Agent, or Firm* — John C. Shepard

(57) ABSTRACT

A handheld massage device that may be employed to provide therapeutic massage to a user's backside includes a user-grippable, generally hook-shaped handle and a massage tool mounted at one end thereof. The massage tool has a plurality of body-contacting work elements that may be selectively moved into operative position and locked in place. A releasable, spring-loaded locking mechanism is provided between the handle and the massage tool so that the tool is locked in position when engaged and unlocked and rotatable when disengaged. The handle may be formed as an integral piece or in segments that can be assembled in end-to-end relation or disassembled and compactly folded for storage. In segmented form, a resilient line may extend internally within tubular segments between the respective end segments to securely hold the handle segments together and cooperating parts axially and rotationally align the separable segments when assembled.

19 Claims, 7 Drawing Sheets

(56) References Cited

U.S. PATENT DOCUMENTS

| | | | | |
|---|---|---|---|---|
| D359,124 | S | 6/1995 | Rosenberg | |
| 5,560,746 | A | 10/1996 | Willow | |
| D402,764 | S | 12/1998 | Chatfield | |
| D403,431 | S | 12/1998 | Gladieux, Jr. | |
| D405,536 | S | 2/1999 | Haynes | |
| D423,676 | S | 4/2000 | Lazio | |
| D436,181 | S | 1/2001 | Lazio | |
| D444,566 | S | 7/2001 | Thomas et al. | |
| 6,261,251 | B1 | 7/2001 | Meyers | |
| D456,909 | S | 5/2002 | Szabo | |
| D461,009 | S | 7/2002 | Viner | |
| 6,758,826 | B2 | 7/2004 | Luettgen et al. | |
| D497,004 | S | 10/2004 | Kung | |
| 7,122,015 | B2 | 10/2006 | Luettgen et al. | |
| D539,915 | S | 4/2007 | Timmer | |
| D554,270 | S | 10/2007 | Ano | |
| D590,510 | S | 4/2009 | Johansen et al. | |
| D646,794 | S | 10/2011 | Hennessey | |
| 2003/0009116 | A1* | 1/2003 | Luettgen | A61H 19/34 601/46 |
| 2003/0154828 | A1* | 8/2003 | Weaver | B25B 13/56 81/124.4 |
| 2004/0215115 | A1* | 10/2004 | Sheen | A61H 1/008 601/135 |
| 2011/0224588 | A1* | 9/2011 | Grippo | A61H 7/003 601/135 |
| 2013/0066245 | A1* | 3/2013 | Dagan | A61H 7/003 601/118 |
| 2014/0069475 | A1* | 3/2014 | Lenhart | A45B 9/00 135/74 |

* cited by examiner

Fig. 6
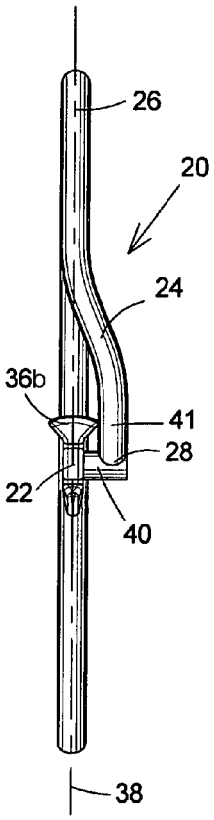
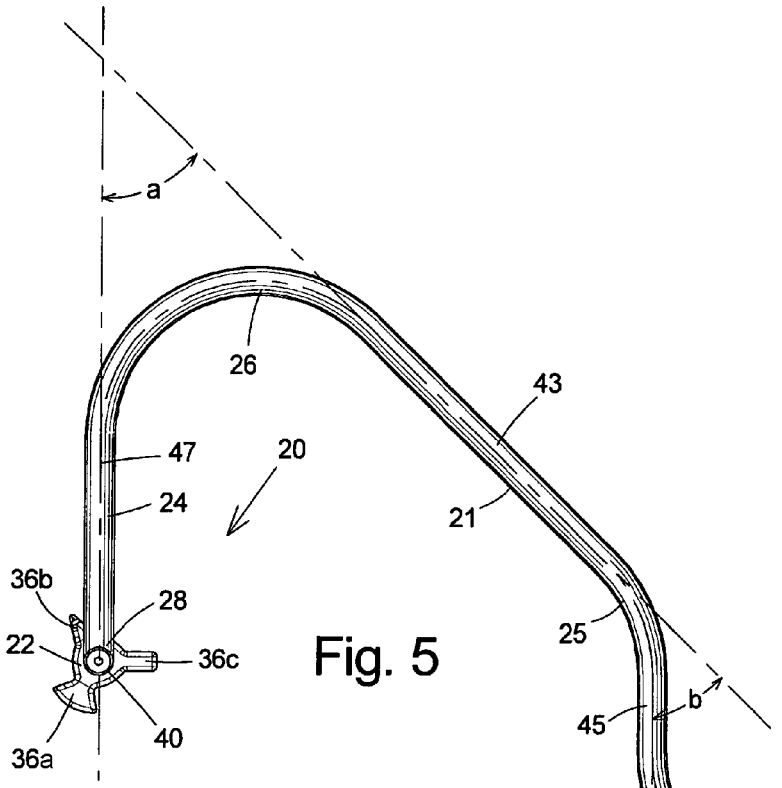
Fig. 5
Fig. 7
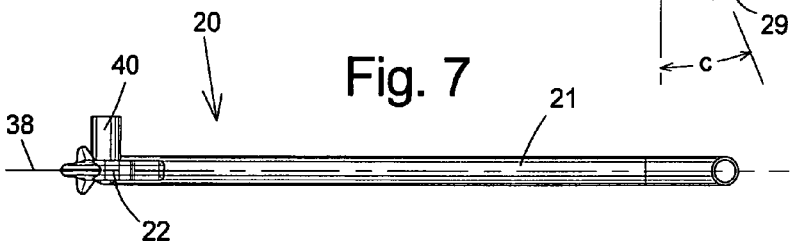

HANDHELD MASSAGE DEVICE

CROSS-REFERENCE TO RELATED APPLICATIONS

This application claims the benefit of and is a continuation-in-part of my U.S. patent application Ser. No. 29/432,715, filed on Sep. 19, 2012, currently pending, the disclosure of which is incorporated herein by reference in its entirety.

BACKGROUND OF THE INVENTION

1. Technical Field

The invention pertains to a massage device and, more particularly, to a handheld massage device with an indexable therapeutic tool locatable and lockable in a plurality of usable configurations.

2. Background Art

Massage therapists apply various techniques when treating an individual, dependent upon the condition of the individual. Some therapists have made use of various tools designed to more effectively and/or more easily apply various therapeutic techniques. Different tools, including the commonly used T-bar, have had varying degrees of success. Some tools may improve some aspects related to applying a particular therapy, while sometimes making other aspects worse. Other tools may fall short of the desired effect, or may be the victim of ever increasing demands that they were never intended to meet and/or address. Consequently, there is an ever-increasing demand to develop more effective techniques, some of which may only be possible with an appropriate tool. Furthermore, there is a demand to increase the effectiveness of existing tools.

Several techniques require the targeted application of pressure and/or force. At least a couple of examples include muscle stripping, trigger point, friction, and effleurage. Furthermore, the addition of force to other types of therapies can sometimes improve their effectiveness. However, the persistent application of force can, in some instances, be taxing on a therapist or on a self-administering user. Consequently, techniques and/or tools, which can assist in the application of force or can more effectively apply an existing force can serve to relieve some of the strain.

Furthermore, tools which help combine the effective application of force with other therapies may also be beneficial. Still further, techniques or tools that help to eliminate other impediments to the application of an effective treatment, either to the recipient of the treatment, or the person applying the treatment, would additionally be beneficial.

Examples of massage tools that may be employed in such therapy are described in my patents, U.S. Pat. No. 7,431,706, issued Oct. 7, 2008, entitled "Generally Triangular-Shaped Tool with Three Different Contact Elements," and U.S. Pat. No. D542,926, issued May 15, 2007, entitled "Massage Tool." Usually, one cannot provide suitable therapeutic massage to one's self, particularly in the area of the back or side. A therapist is required to administer such therapy.

BRIEF SUMMARY OF THE INVENTION

The present invention is directed to overcoming one or more of the problems as set forth above.

It is an object of the present invention to provide a compact, multifunctional tool that emulates the human hand while performing massage therapy thereby reducing fatigue and increasing the sensation and effect on the recipient.

It is also an object of the present invention to provide a handheld massage device that can easily be used on all parts of the user's body by the user working alone, has multiple tool elements for varying types of therapy, and yet has a minimum number of components, has few manufacturing complexities, and is relatively inexpensive.

In one aspect of the invention, a therapeutic massage tool having a plurality of user-selectable body-engaging contact elements is carried on one end portion of a handle and the other end portion is grippable by a user.

In another aspect of the invention, the massage tool is rotatably mounted on the handle and may be turned to multiple positions to orient any of contact elements relative to the handle.

One feature of the present invention is that a releasable locking mechanism is provided so that when the locking mechanism is engaged, the massage tool is locked in fixed position relative to the handle, and when the locking mechanism is disengaged, the massage tool is unlocked and may be moved to a different position.

Another feature of the invention is that the locking mechanism is manually-operated and rotation of the massage tool relative to the handle and unlocking and locking thereof can be easily accomplished manually by using one hand in one motion without the use of tools.

A further feature of the invention is that the locking mechanism is spring-loaded so that during use the massage tool is automatically locked in position relative to the handle.

In one embodiment of the invention, the handle is integrally formed as a single rigid piece with the massage tool at one end and a user grip at the other end.

In a second embodiment of the invention, the handle is formed from a plurality of separate rigid pieces that may be assembled in end-to-end relation and disassembled as desired.

A feature of the second embodiment is that the separate pieces are interconnected by a resilient line that biases the pieces together but allows the pieces to be manually pulled apart and compactly folded for transport or storage.

A further feature of the second embodiment is that the adjoining pieces have axial and radial aligners so that when the pieces are unfolded, the pieces are automatically pulled together in end-to-end relation by the resilient line and are located in proper position by the cooperating aligners.

BRIEF DESCRIPTION OF THE SEVERAL VIEWS OF THE DRAWINGS

The details of construction and operation of the invention are more fully described with reference to the accompanying drawings which form a part hereof and in which like reference numerals refer to like parts throughout.

In the drawings:

FIG. 5 is a back elevational view of the therapy device shown in FIG. 1;

FIG. 6 is a right side elevational view of the therapy device shown in FIG. 1;

FIG. 7 is a bottom plan view of the therapy device shown in FIG. 1;

Figure 1:
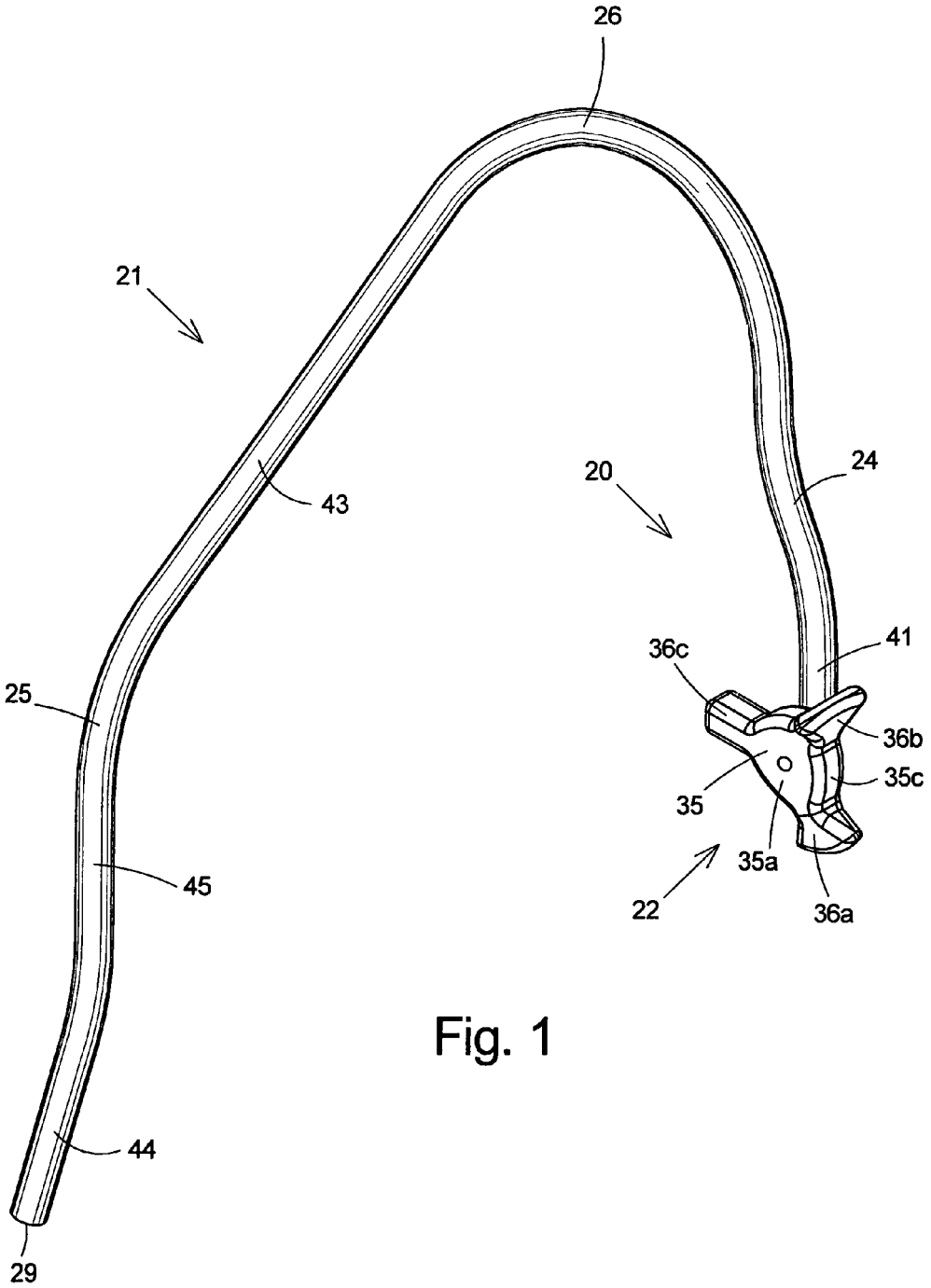
FIG. 1 is a top, front, right side perspective view of an embodiment of a therapy device constructed in accordance with the present invention.
Figure 4:
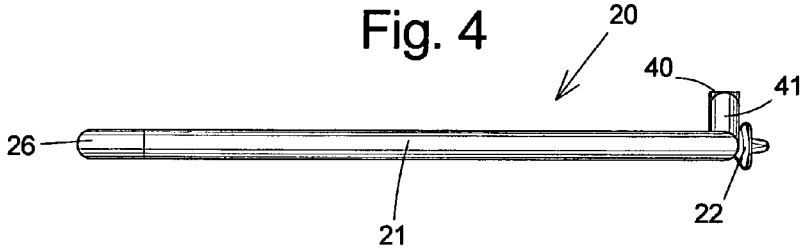
FIG. 4 is a top plan view of the therapy device shown in FIG. 1.
Figure 3:
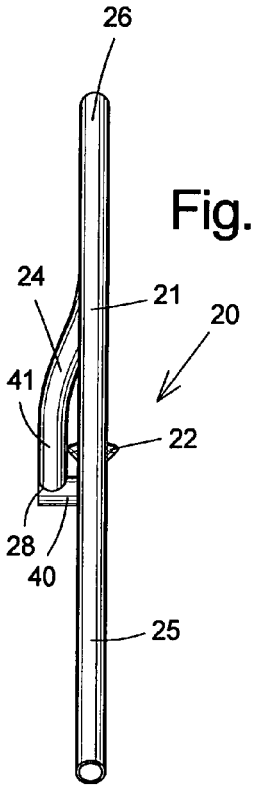
FIG. 3 is a left side elevational view of the therapy device shown in FIG. 1.
Figure 2:
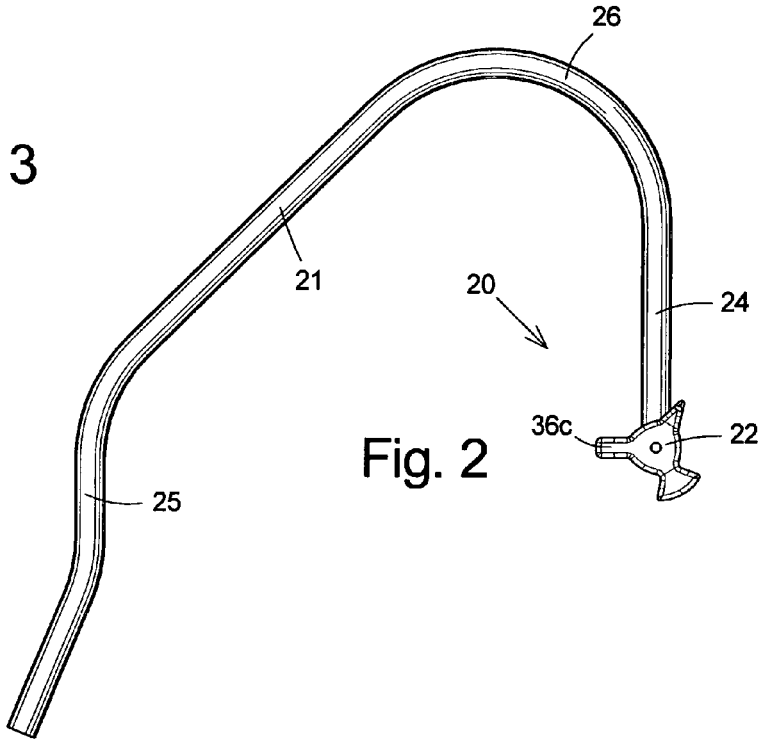
FIG. 2 is a front elevational view of the therapy device shown in FIG. 1.
Figure 8:
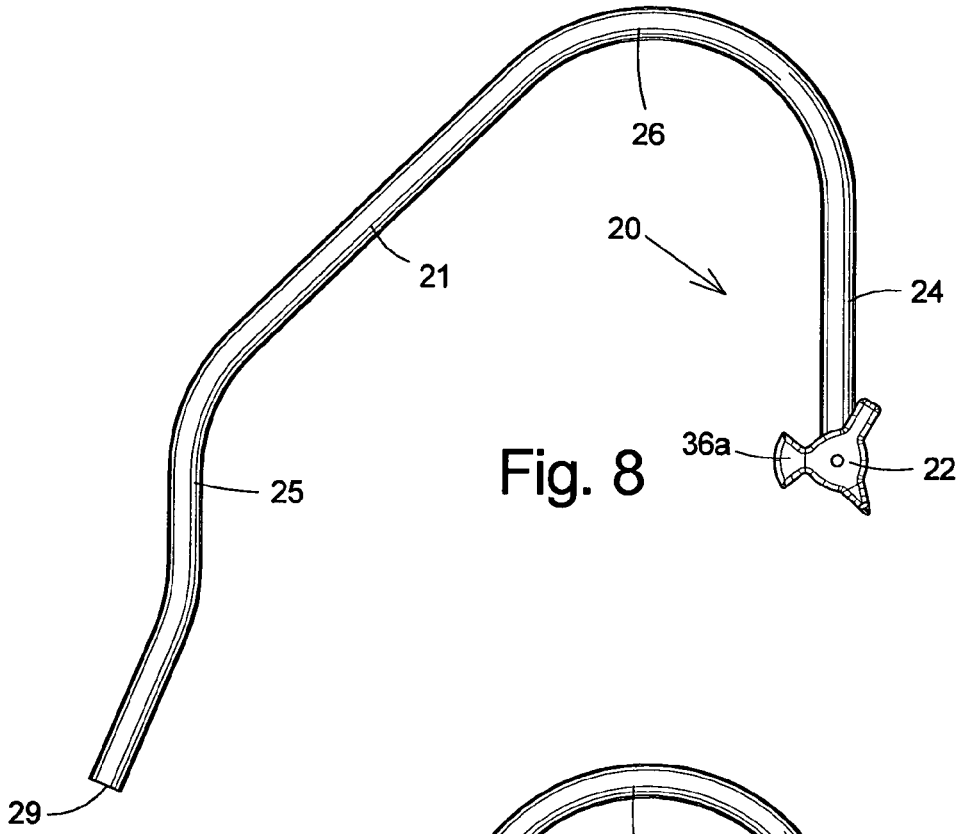
FIG. 8 is a front elevational view of the therapy device shown in FIG. 1 with the massage tool rotated 120° clockwise to an alternative position.
Figure 9:
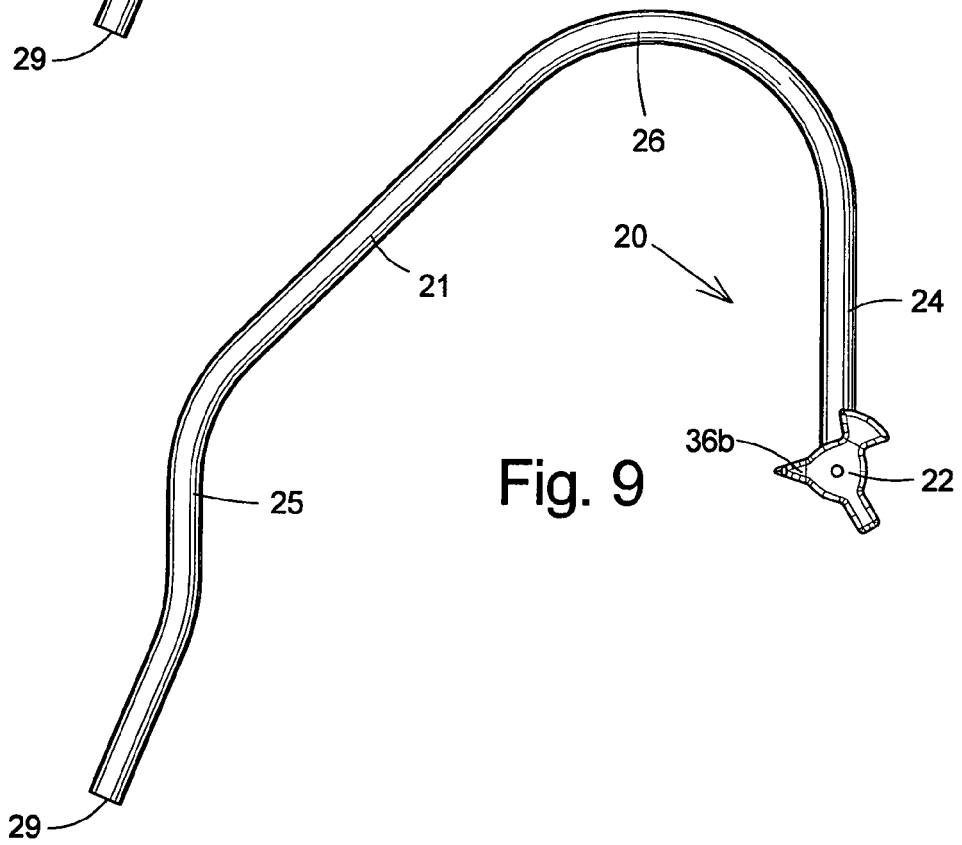
FIG. 9 is a front elevational view of the therapy device shown in FIG. 1 with the massage tool rotated 120° counterclockwise to an alternative position.

All figures are drawn for ease of explanation of the basic teachings of the present invention only; the extensions of the figures with respect to number, position, relationship, and dimensions of the parts to form the preferred embodiment will be explained or will be within the skill of the art after the following teachings of the present invention have been read and understood.

DETAILED DESCRIPTION OF THE PREFERRED EMBODIMENTS

While the present invention is susceptible of embodiment in many different forms, there are shown in the drawings and will be described herein in detail specific embodiments thereof with the understanding that the present disclosure is to be considered as an exemplification of the principles of the invention and is not intended to limit the invention to the specific embodiments illustrated.

Referring to the drawings, a handheld massage device, generally designated 20, is seen to include a rigid, wrap-around handle, generally designated 21, and a therapeutic massage tool, generally designated 22, rotatably mounted to one end of the handle.

Figure 10:
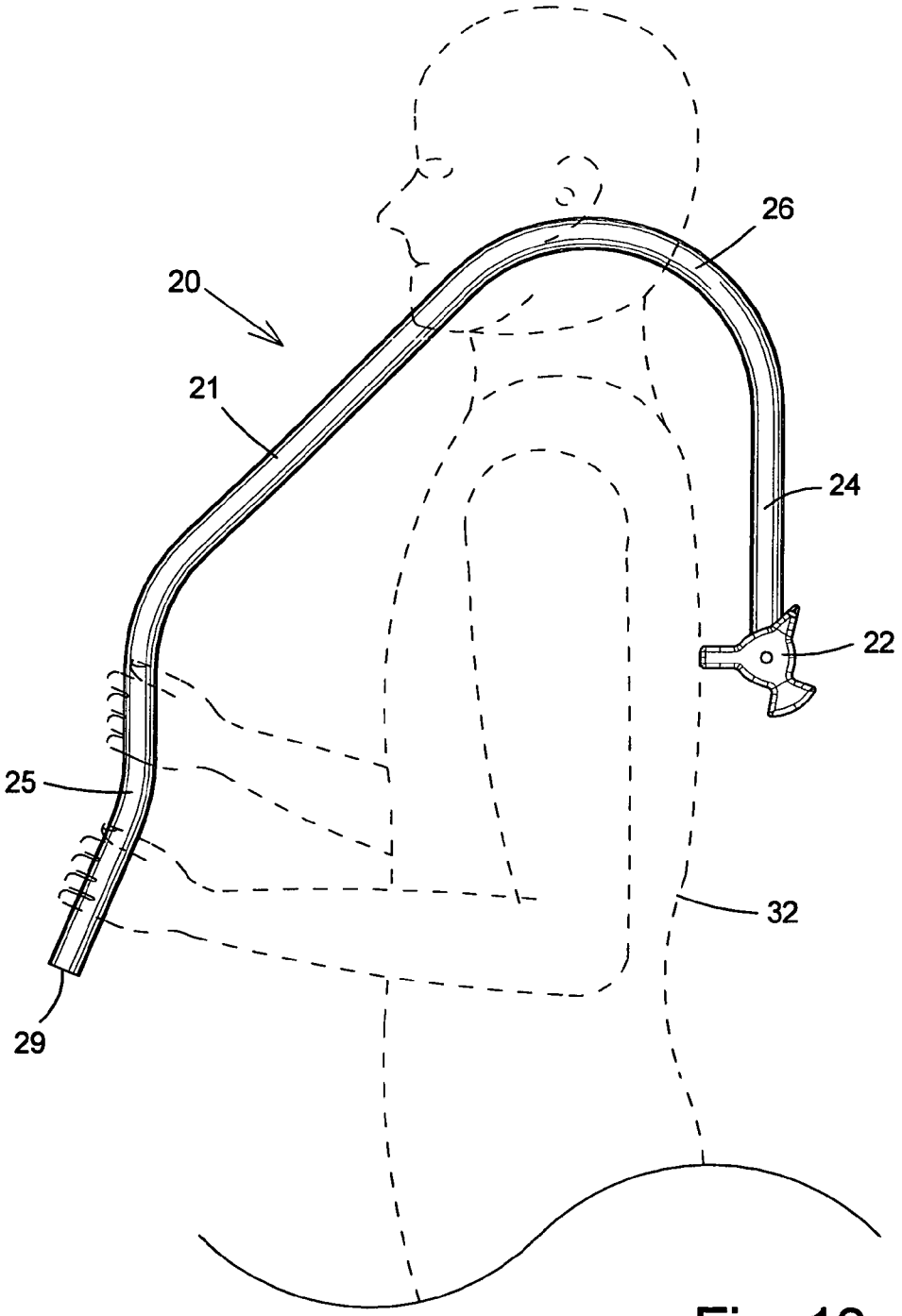
FIG. 10 is a front elevational view of the therapy device shown in FIG. 1 as it might be employed by a user.

The handle 21 has first and second end portions 24 and 25 joined by an intermediate arcuate bend portion 26. The first and second end portions 24 and 25 each have inner ends that connect with the opposite ends of the bend portion 26 and diverge from one another with their outer ends terminating in respective handle ends 28 and 29 that define a relatively large gap (not numbered) therebetween. The handle first end portion 24 provides an offset allowing for the mounting of the massage tool 22 and as seen in FIG. 10 has a length sufficient to reach the lower back, while the handle second end portion 25 has a length sufficient to permit it to be gripped by the user 32 forward of the torso or waist. The handle 21 wraps around or encircles the user 32 when it is be placed on or over the user's body, shoulder, torso, neck, or other body part.

In one use of the massage device 20 as seen in FIG. 10, the handle 21 is positioned over the user's shoulder with the rearward first end portion 24 mounting the massage tool 22 extending downwardly generally along user's back and the forward second end portion 25 positioned so that it extends angularly forward of the user's chest and can be gripped appropriately. The handle 21 may be gripped by a user along any portion thereof.

The handle 21 can be integrally formed from a single piece of round tube or rod made of steel, aluminum, or other suitable metals, or high-strength plastic. The handle 21 is generally hook-shaped, but it can be suitably sized or configured with arcuate curves, partial loops, or angular bends or folds to form a J-shape, U-shape, V-shape, C-shape, or similar shape that defines a gap opening into an internal throat (not numbered) that allows it to at least partially wrap around a user's body or torso.

The massage tool 22 shown herein includes a central body portion or hub 35 with opposed side surfaces 35*a* and 35*b* on either side of the hub and three different circumferentially-spaced, body-contacting work elements 36*a*, 36*b*, and 36*c* extending radially outward from the hub edge surfaces 35*c*, which merge into the side surfaces 35*a* and 35*b*. The massage tool has as body contact elements: a wedge 36*a*, a cross-wedge 36*b*, and a blunt or broad point 36*c*. The massage tool 22 may be made of metal, plastic, plastic-coated metal, or any other suitable material. It is understood that other configurations and arrangements for working contact elements may be employed herein and that their number may be modified as desired.

As seen in FIG. 5, the first end portion 24 of the generally J-shaped handle 21 is shorter than the second end portion 25. The handle bend portion 26 has a radius of approximately 5 inches and subtends an angle of about 135° so that the first and second handle end portions 24 and 25 initially diverge away from one another at an angle of 45° as indicated at a in FIG. 5.

The handle end portion 25 and bend portion 26 are aligned along the plane indicated by line 38 shown in FIGS. 6 and 7. The handle first end portion 24 has a transverse section, or tool mount 40, that is fixed to the end of offset section 41 of the handle first portion 24. The massage tool 22 is rotatably mounted at one end of the tool mount 40 with the work elements 36 aligned with the handle plane 38. The offset section 41 is laterally spaced from the plane 38, allowing the massage tool 22 to be rotated without interference of the handle 21.

The handle second end portion 25 includes a first straight section 43, a second straight section 44, and an intermediate bend or angled third section 45 joining the first and second straight sections 43 and 44. The first straight section 43 joins the angled section 45 and the handle bend portion 26. The second straight section 44 is joined with the angled section 45 and terminates in the handle free end 29.

The angled section 45 bends inwardly toward the handle first end portion 24 at about a 45° angle as indicated at b in FIG. 5 and then outwardly away from the handle first end portion at about a 22.5° angle as indicated at c in FIG. 5. This overall configuration allows the handle 21 to wrap around the user's shoulder with the handle 21 extending downwardly and forwardly from the chest of the user 32 when the massage tool 22 is placed along the back allowing the user to easily grip the second end portion 25 and vertically raise and lower the tool 22 and adjust the angle of the tool 22 on the back. Typically, the tool 22 will be rotated so that the contact element being used is substantially perpendicular to the body.

Adjusting the position of the handle 21 forward of the body changes the vertical and horizontal position or angle of the massage tool 22. Pushing the handle 21 away from the body increases the force applied. Small motions of the handle 21 can effect rubbing or change the pressure imparted to the user's body. The angular bends in the second end portion 25 allow a user 32 to leverage the handle 21 to adjust the relative angle of the device 20 and its lateral position and height.

Mounting of the massage tool 22 to the handle 21 is best described with reference to FIGS. 11-15, wherein a second embodiment is shown, the massage tool 22 being mounted on handle 81. The releasable locking mechanism, generally designated 50, operates in a fashion similar to a spring-loaded, dog-type clutch. The locking mechanism 50 is a positive coupling mechanism provided between the handle 81 and massage tool 22 and allows the user 32 when it is uncoupled to reposition a body-contacting element 36 of the tool 22 and lock the tool in place when it is recoupled. Engagement of the locking mechanism 50 locks the massage tool 22 in position relative to the handle 81 while disengagement allows the tool 22 to be rotated or indexed so as to locate the body-contacting elements 36 in a position that will be substantially perpendicular to the user.

The releasable locking mechanism 50 includes cooperating parts on the handle 81 and the massage tool 22. The locking mechanism part on the massage tool includes a circular depression 52 centrally formed in the side surface 35*b* and a triangularly-shaped cavity 53 formed in the bottom of the depression 52 defining an upright, triangularly-shaped, internal shoulder 54. A counterbore 56 extends from the bottom of the cavity 53 to a shoulder 57 spaced inward from the side surface 35*a* of the tool 22. A throughhole 58 extends axially through the massage tool 22 from the tool side surface 35*a* into the counterbore 56.

The locking mechanism part on the handle is formed as part of tubular tool mount 40 fixed transversely to the offset section 41. One end portion 60 of the tool mount 40 has a circular cross-section insertable within the tool circular depression 52 sized to receive it. The end of the tool mount 40 facing the massage tool 22 includes a tall spindle 61 extending axially outward from a triangularly-shaped key 62 projecting from a closing end wall 63 defining an upright, triangularly-shaped, external shoulder 64. The spindle 61 is slidable within the tool counterbore 56 and guides axial movement of the tool 22. When the tool 22 is slid onto the spindle 61, the projecting key 62 can be inserted into the tool cavity 53 with the respective shoulders 54 and 64 abutting so as to lock the massage tool 22 against rotation relative to the handle.

The opposite end portion 66 of the tool mount 40 includes a counterbore 67 in which a compression load spring 68 is positioned. A throughhole 69 extends axially from one end of the spindle 61 and through the raised projection 62 and end wall 63. A threaded fastener 70 extends axially within the massage tool throughhole 58, the tool mount throughhole 69, and the compression spring 68. The fastener head 70*a* abuts the side surface 35*a* of the massage tool 22 and a washer 71 and threaded nut 72 are placed onto the end of the fastener 70 to hold the compression spring 68 within the counterbore 67 between the end wall 63 of the counterbore 67 and washer 71 and thereby hold the tool 22 on the spindle 61.

To rotate the massage tool 22 and orient a working element in desired radial position, the tool 22 is manually pulled axially outward from the tool mount 40 against the bias of the spring 68 to uncouple the tool from the handle, angularly turned 120° to another index position, and released. Spring force biases the tool 22 back to recouple and engage the cooperating triangular shoulders 54 and 64 and lock the tool 22 in selected position.

It is understood that other constructions for the locking mechanism may be employed to effecting a dog-type clutch. Such constructions might include the use of an upright pin aligning with circumferentially-spaced holes, the use of spaced keys and keyways, or the use of radially-extending ridges and grooves.

The handle offset 41 permits the tool 22 to be centered relative to the overall plane of the massage device and be rotated without interference from the supporting handle. The tool shown herein rotates about an axis that extends transversely through the hub side surfaces 35*a* and 35*b* and is traverse to the handle non-linear centerline 47. The tool body contact elements 36 are aligned along the handle plane 38 and rotate through the handle centerline 47. It is understood that the tool may be mounted in many different orientations. For example, the tool may be mounted so that it rotates about an axis common to the centerline so that the contacting elements rotate about the handle centerline.

Figure 11:
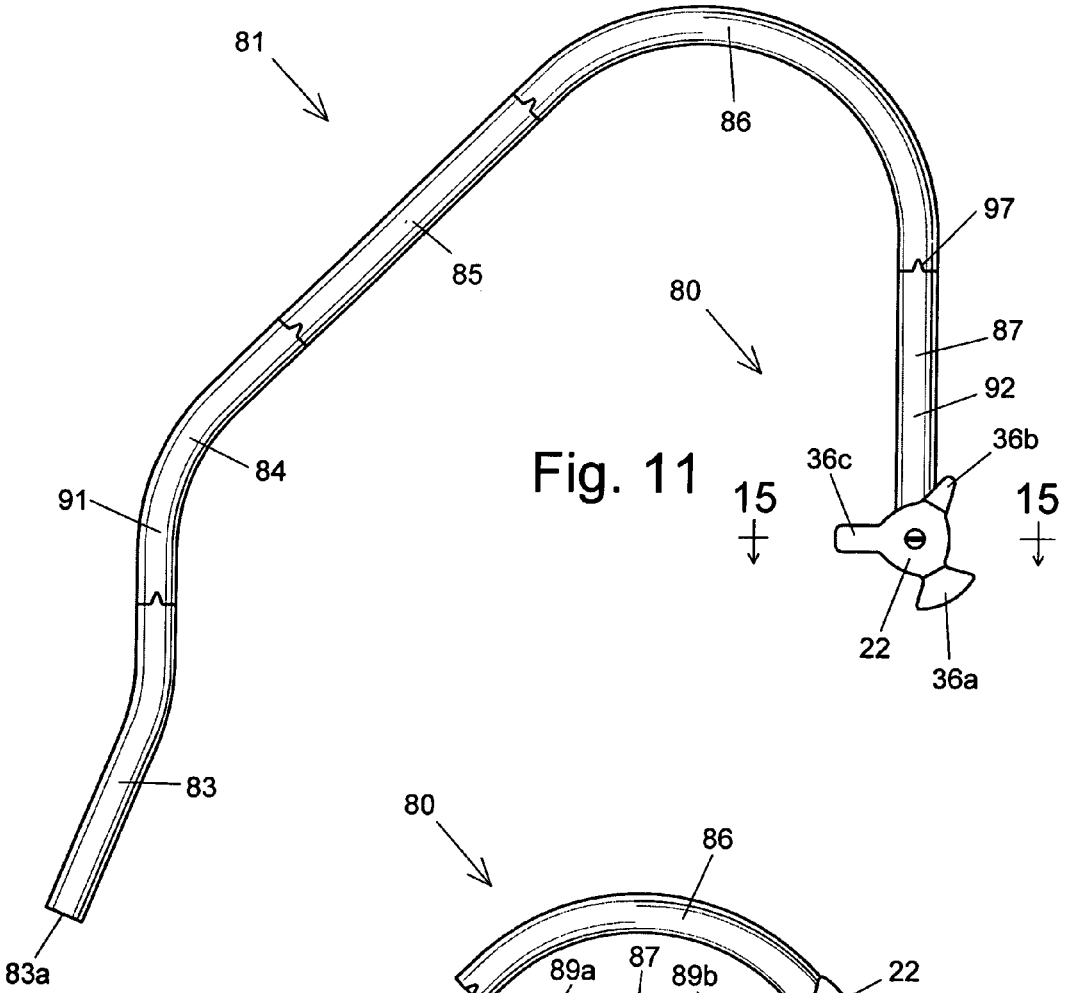
FIG. 11 is a front elevational view of a second embodiment of a therapy device constructed in accordance with the present invention.
Figure 12:
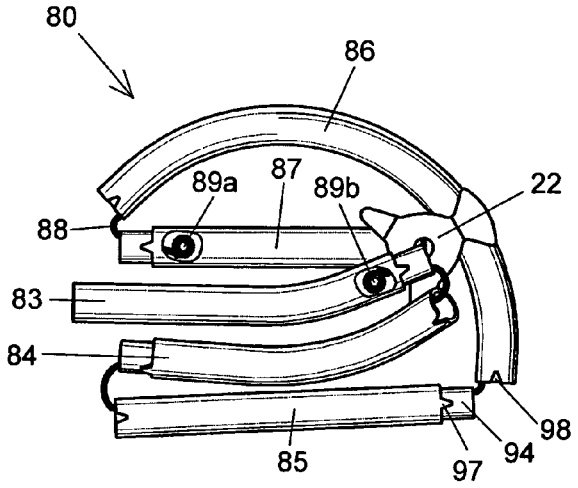
FIG. 12 is a front elevational view partially broken away of the therapy device shown in FIG. 11 disassembled and folded.
Figure 15:
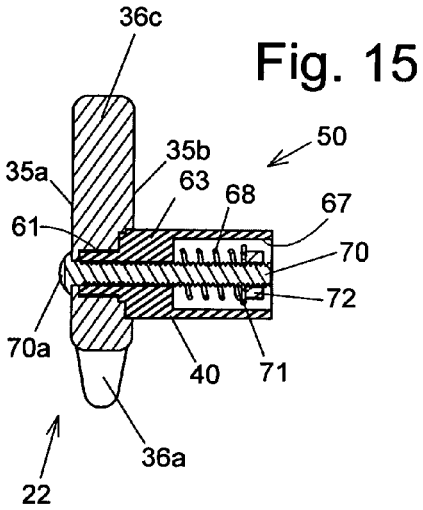
Figure 14:
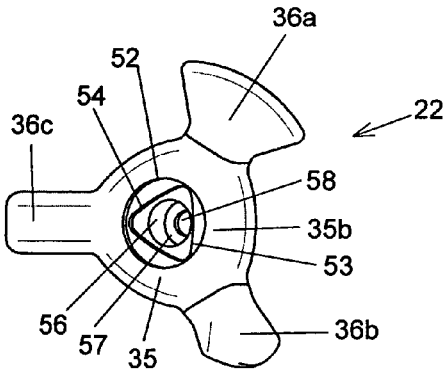
FIG. 14 is an enlarged, perspective view of the back of the massage tool shown in FIG. 13; and, FIG. 15 is an enlarged, partial cross-sectional view taken along line 15-15 of FIG. 11 showing the configuration of the massage tool mount.

In FIGS. 11-15, an alternative construction of the hand-held massage device, generally designated 80, is shown and includes a segmented handle, generally designated 81, and indexable therapeutic massage tool 22. The handle 81 is comprised of a plurality of rigid, tubular segments 83-87 that may be connected together in end-to-end abutting relation or disconnected and separated. The handle segments 83-87 are releasably held together by a resilient line 88, which may also be a cable, shock cord, bungee, or the like. The ends of the line 88 are secured to respective end segments 83 and 87 by anchors 89*a* and 89*e* fixed therewithin as seen in FIG. 12.

The handle 81 has one end portion, generally designated 91, that is comprised of first angled end segment 83 having a handle-terminating end 83*a*, straight segment 85, and second angled intermediate segment 84 having one end connectable to the end of the first angled segment 83 opposite the handle-terminating end 83*a* and its other end connectable to one end of the straight segment 85. The other handle end portion, generally designated 92, is comprised of offset segment 87 having an end terminating in tool mount 40. Arcuate bend segment 86 is located intermediate the handle end portions 91 and 92 and has one end connectable to the straight segment 85 and its opposite end connectable to the offset segment 87.

The massage device 80 may be manually pulled apart, disassembled and folded for storage or transport as shown in FIG. 12. When the user unfolds the massage device 80, the biasing force of the resilient line 88 automatically pulls on the segments 83-87 and tightly holds them in end-to-end assembled relation. When assembled, the massage device 80 has the same configuration and functionality as the massage device 20 shown in FIGS. 1-10.

Figure 13:
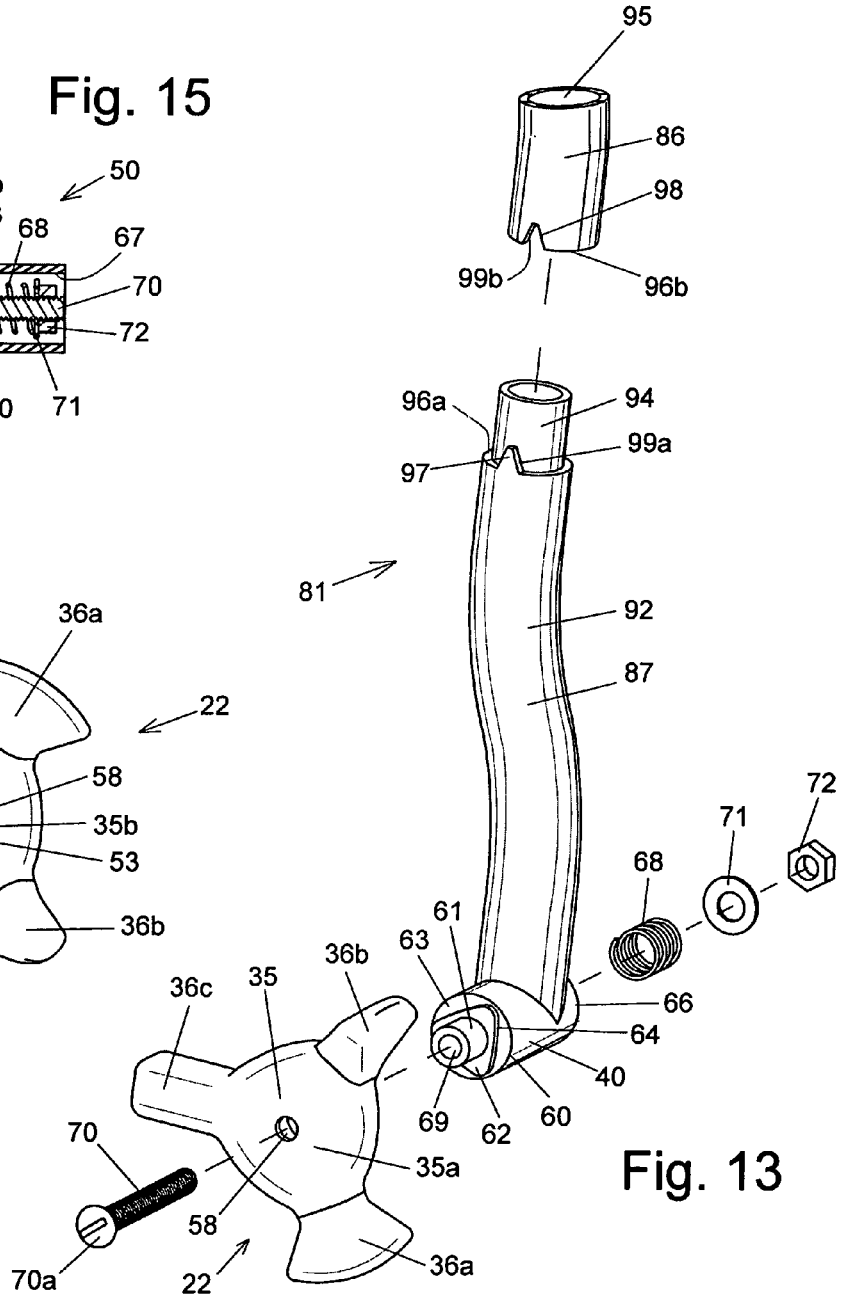
FIG. 13 is an enlarged, exploded, partial perspective view of the therapy device shown in FIG. 11 showing the massage tool mount and a handle tube joint.

Connectable segments 83-87 are held in axially end-to-end alignment by cooperating male/female parts on the ends of each pair of adjacent segments. As best shown in FIG. 13 illustrating the connection between segments 86 and 87, one of the abutting segment pair includes an internal guide tube 94 securely fixed within the tubular segment or otherwise formed at the tube end. The guide tube 94 extends axially outward from segment 87. The other of the segment pair has an inner surface 95 formed so that it may slide axially over and cooperatively engage the internal guide tube 94 until the end edges 96*a* and 96*b* are in abutting relation. The outer diameter of internal guide tube 94 of segment 87 and the inner diameter at the end of segment 86 are matched so that their size and shape so that they mate and provide a relatively snug interference fit. The external surface of the guide tube end and the internal surface of the segment 86 together function as axial aligners.

To maintain adjacent segments in rotational alignment, cooperating tabs 97 and slots 98 are provided and together function as rotational aligners. As seen in FIG. 11-13, one of each segment pair includes a tapering tab 97 extending axially outward from its end edge while the other of each abutting segment pair includes a tapering slot 98 of corresponding size and shape cut into end edge 96*a*. When the segments are joined together the tapering male tab and female slot edge surfaces cooperatively engage and mate fixing the segments against relative rotation. The tapering edges facilitate final rotational alignment if the segments are initially rotationally misaligned during connection.

It is understood that the handle 81 may be formed with any number of intermediate segments, or none at all.

INDUSTRIAL APPLICABILITY

It should be apparent that the massage device described herein is simple, inexpensive and easily constructed and yet is functional and efficient providing an effective construction for delivering massage therapy.

Other aspects, objects and advantages of this invention can be obtained from a study of the drawings, the disclosure and the appended claims.

It should be apparent that the pump described herein is simple and functional, but yet is effective and be easily manufactured. It should also be understood that the terms "top," "bottom," "forward," "rearward," "inner," "outer," "end," "side," "first," "second," and similar terms as used herein, have reference only to the structure shown in the drawings and are utilized only to facilitate describing the invention. The terms and expressions employed herein have been used as terms of description and not of limitation.

From the foregoing, it will be observed that numerous variations and modifications may be effected without departing from the spirit and scope of the invention. It is to be understood that no limitation with respect to the specific embodiments illustrated herein is intended or should be inferred. While specific embodiments of the invention have been disclosed, one of ordinary skill in the art will recognize that one can modify the dimensions and particulars of the embodiments without straying from the inventive concept.

What is claimed is:

1. A therapy device for providing therapeutic contact with the body of a user comprising:

a handle having a first end portion and a second end portion joined by an intermediate bend portion, said end portions defining a gap therebetween;

a therapeutic tool movably mounted to said first end portion of said handle and having a plurality of body contact elements locatable in a plurality of positions;

a releasable locking mechanism including a first part on said first end portion, a second part on said therapeutic tool movable between engaged and disengaged positions with said first part, and a spring means biasing said first part and said second part into engagement to hold said therapeutic tool in fixed position relative to said handle; and, whereby said therapeutic tool on said handle first end portion is positionable rearwardly of the user's body and said handle second end portion is grippable forwardly of the user's body, and whereby manual force may be applied to overcome spring force to allow disengagement of said releasable locking mechanism parts allowing said plurality of body contact elements to be located to one of said plurality of positions.

2. The therapy device of claim 1 wherein said therapeutic tool has three contact elements and said first part of said releasable locking mechanism includes a generally triangularly-shaped key and said second part of said releasable locking mechanism includes a generally triangularly-shaped cavity correspondingly sized and shaped to engage said key therein.

3. The therapy device of claim 1 wherein said therapeutic tool has a central hub and said plurality of body contact elements extend outwardly from said central hub, and said central hub is mounted to said first end portion of said handle for rotation about an axis when said releasable locking mechanism is disengaged.

4. The therapy device of claim 3 wherein said central hub has opposed side surfaces and edge surfaces merging into said side surfaces, said contact elements extend radially outward from said edge surfaces, and said therapeutic tool is mounted for rotation about an axis extending transversely through said side surfaces.

5. The therapy device of claim 1 wherein said second end portion and said intermediate bend portion of said handle extend along a non-linear line and said therapeutic tool is mounted for rotation about an axis transverse to said non-linear line when said releasable locking mechanism is disengaged.

6. The therapy device of claim 5 wherein said non-linear line lies along a plane and said plurality of body contact elements of said therapeutic tool are aligned along said plane.

7. The therapy device of claim 1 wherein said handle is integrally formed as one piece.

8. The therapy device of claim 1 wherein said handle is formed from a plurality of separable segments assembled in end-to-end relation including a first end segment, a second end segment, and a tubular bend segment intermediate said first end segment and said second end segment.

9. The therapy device of claim 8 wherein said plurality of separable segments of said handle are connected together by a resilient line, said resilient line passing through said tubular bend segment.

10. The therapy device of claim 9 further including at least two intermediate handle segments intermediate said first end segment and said second end segment, said at least two intermediate handle segments being tubular and said resilient line passing through said intermediate handle segments.

11. The therapy device of claim 10 wherein at least one of said intermediate handle segments has an arcuate portion.

12. The therapy device of claim 8 wherein said plurality of separable segments comprises pairs of adjacent segments, and further including an axial aligner on each pair of adjacent segments to axially align adjacent segments, said axial aligners including a first axial aligner part on one adjacent segment and a mating second axial aligner part on the other adjacent a segment, a rotational aligner on each pair of adjacent segments to rotationally align adjacent segments, said rotational aligners including a first rotational aligner part on one adjacent segment and a mating second rotational aligner part on the other adjacent segment.

13. A therapy device for providing therapeutic contact with the body of a user comprising:

a handle having a plurality of separable segments in end-to-end relation, said handle including a first end segment, a second end segment, and a tubular bend segment intermediate said first end segment and said second end segment, said end segments defining a gap therebetween, and wherein said plurality of separable segments comprises pairs of adjacent segments;

a therapeutic tool movably mounted to said first end segment and having a plurality of body contact elements locatable in a plurality of positions;

a releasable locking mechanism including a first part on said first end segment of said handle, a second part on said therapeutic tool movable between engaged and disengaged positions with said first part, and a spring means biasing said first part and said second part into engagement to hold said therapeutic tool in fixed position relative to said handle;

a resilient line extending between said first end segment and said second end segment of said handle and through said tubular bend segment;

an axial aligner on each pair of adjacent segments to axially align adjacent segments, said axial aligners including a first axial aligner part on one adjacent segment and a mating second axial aligner part on the other adjacent segment;

a rotational aligner on each pair of adjacent segments to rotationally align adjacent segments, said rotational aligners including a first rotational aligner part on one adjacent segment and a mating second rotational aligner part on the other adjacent segment; and, whereby said therapeutic tool on said first end segment of said handle is positionable rearwardly of the user's body and said second end segment of said handle is grippable forwardly of the user's body, whereby manual force may be applied to overcome spring force to allow disengagement of said releasable locking mechanism parts allowing said therapeutic tool contact elements to be located to one of said plurality of positions, and whereby said therapy device may be placed in a disassembled configuration by pulling the handle segments apart and in an assembled configuration by releasing the segments and allowing the resilient line to pull the handle together end-to-end with respective axial aligners and rotational aligners engaging so as to hold and align said plurality of segments of said handle together.

14. The therapy device of claim 13 further including at least two segments intermediate said first end segment and said second end segment, said at least two segments being tubular and said resilient line passing through said at least two segments.

15. The therapy device of claim 14 wherein at least one segment of said handle has an arcuate portion.

16. The therapy device of claim 13 wherein said therapeutic tool has three body contact elements and said first part of said releasable locking mechanism includes a generally triangularly-shaped key and said second part of said releasable locking mechanism includes a generally triangularly-shaped cavity correspondingly sized and shaped to engage said key therein.

17. The therapy device of claim 13 wherein said therapeutic tool has a central hub and said body contact elements extend outwardly from said central hub, and said central hub is mounted to said first end segment of said handle for rotation about an axis when said releasable locking mechanism is disengaged.

18. The therapy device of claim 17 wherein said central hub has opposed side surfaces and edge surfaces merging into said side surfaces, said body contact elements extend radially outward from said edge surfaces, and said therapeutic tool is mounted for rotation about an axis extending transversely through said side surfaces.

19. A therapy device for providing therapeutic contact with the body of a user comprising:

a handle having a plurality of separable segments in end-to-end relation, said handle including a first end segment, a second end segment, and a tubular bend segment intermediate said first end segment and said second end segment, said end segments defining a gap therebetween, and wherein said plurality of separable segments comprises pairs of adjacent segments;

a therapeutic tool movably mounted to said first end segment of said handle and has a plurality of body contact elements locatable in a plurality of positions;

a releasable locking mechanism including a first releasable locking mechanism part on said first end segment of said handle, a second releasable locking mechanism part on said therapeutic tool movable between engaged and disengaged positions with said first releasable locking mechanism part, and a spring means biasing said first releasable locking mechanism part and said second releasable locking mechanism part into engagement to hold said therapeutic tool in fixed position relative to said handle;

a resilient line extending between said first end segment and said second end segment of said handle and through said tubular bend segment;

an axial aligner on each pair of adjacent segments to axially align adjacent segments, said axial aligners including a first axial aligner part on one adjacent segment and a mating second axial aligner part on the other adjacent segment;

a rotational aligner on each pair of adjacent segments to rotationally align adjacent segments, said rotational aligners including a first rotational aligner part on one adjacent segment and a mating second rotational aligner part on the other adjacent segment; and, whereby said therapeutic tool on said first end segment of said handle is positionable rearwardly of the user's body and said second end segment of said handle is grippable forwardly of the user's body, and whereby said therapy device may be placed in a disassembled configuration by pulling said plurality of segments of said handle apart and in an assembled configuration by releasing the segments and allowing the resilient line to pull said plurality of segments of said handle together end-to-end with respective axial aligners and rotational aligners engaging so as to hold and align said plurality of segments of said handle together.

* * * * *